US010660181B1

(12) United States Patent
Hung

(10) Patent No.: US 10,660,181 B1
(45) Date of Patent: May 19, 2020

(54) CONTROLLABLE SILICON LIGHT REGULATION APPARATUS

(71) Applicant: CHAMP TECH OPTICAL (FOSHAN) CORPORATION, Foshan (CN)

(72) Inventor: Chin-Che Hung, Tu-Cheng (TW)

(73) Assignee: CHAMP TECH OPTICAL (FOSHAN) CORPORATION, Foshan (CN)

( * ) Notice: Subject to any disclaimer, the term of this patent is extended or adjusted under 35 U.S.C. 154(b) by 0 days.

(21) Appl. No.: 16/532,714

(22) Filed: Aug. 6, 2019

(30) Foreign Application Priority Data

Aug. 2, 2019 (CN) ..... 2019 1 0713374

(51) Int. Cl.

| | |
|---|---|
| ***H05B 37/02*** | (2006.01) |
| ***H05B 45/50*** | (2020.01) |
| ***H05B 45/10*** | (2020.01) |
| ***H05B 45/20*** | (2020.01) |

(52) U.S. Cl.
CPC ..... *H05B 45/50* (2020.01); *H05B 45/10* (2020.01); *H05B 45/20* (2020.01)

(58) Field of Classification Search
CPC ..... H05B 33/0845; H05B 33/0857; H05B 33/086; H05B 45/10; H05B 45/20
See application file for complete search history.

(56) References Cited

U.S. PATENT DOCUMENTS

2018/0242422 A1* 8/2018 Choi ..... H05B 33/0842

* cited by examiner

*Primary Examiner* — Thuy V Tran
(74) *Attorney, Agent, or Firm* — ScienBiziP, P.C.

(57) ABSTRACT

A controllable silicon light regulation apparatus without a driving power element receives an alternating current (AC) from an AC source comprising a first light emitting diode (LED) source module and a second LED source module. The controllable silicon light regulation apparatus stores specified color temperatures. A difference between adjacent specified color temperatures is 100K. Under a segment dimming mode, the controllable silicon light regulation apparatus sets a segment value and selects a number of the specified color temperatures based on the segment value. A color temperature of the controllable silicon light regulation apparatus is gradually regulated in a loop of target color temperatures based on a counted number of turn-on times in a specified time duration of the AC source.

18 Claims, 2 Drawing Sheets

CONTROLLABLE SILICON LIGHT REGULATION APPARATUS

FIELD

The subject matter herein generally relates to controllable silicon light regulation apparatus.

BACKGROUND

Light emitting diodes (LEDs) are widely used in illumination system based on properties such as energy-efficiency, greenness, controllability, and stability. In a normal illumination system, for dimming a color temperature, a driving source is needed, and the driving source converts an alternating current into a direct current to the LEDs. The cost of the driving source is too high, thus there is a room for improvement.

BRIEF DESCRIPTION OF THE FIGURES

Implementations of the present disclosure will be described, by way of example only, with reference to the figures.

DETAILED DESCRIPTION

Figure 1:
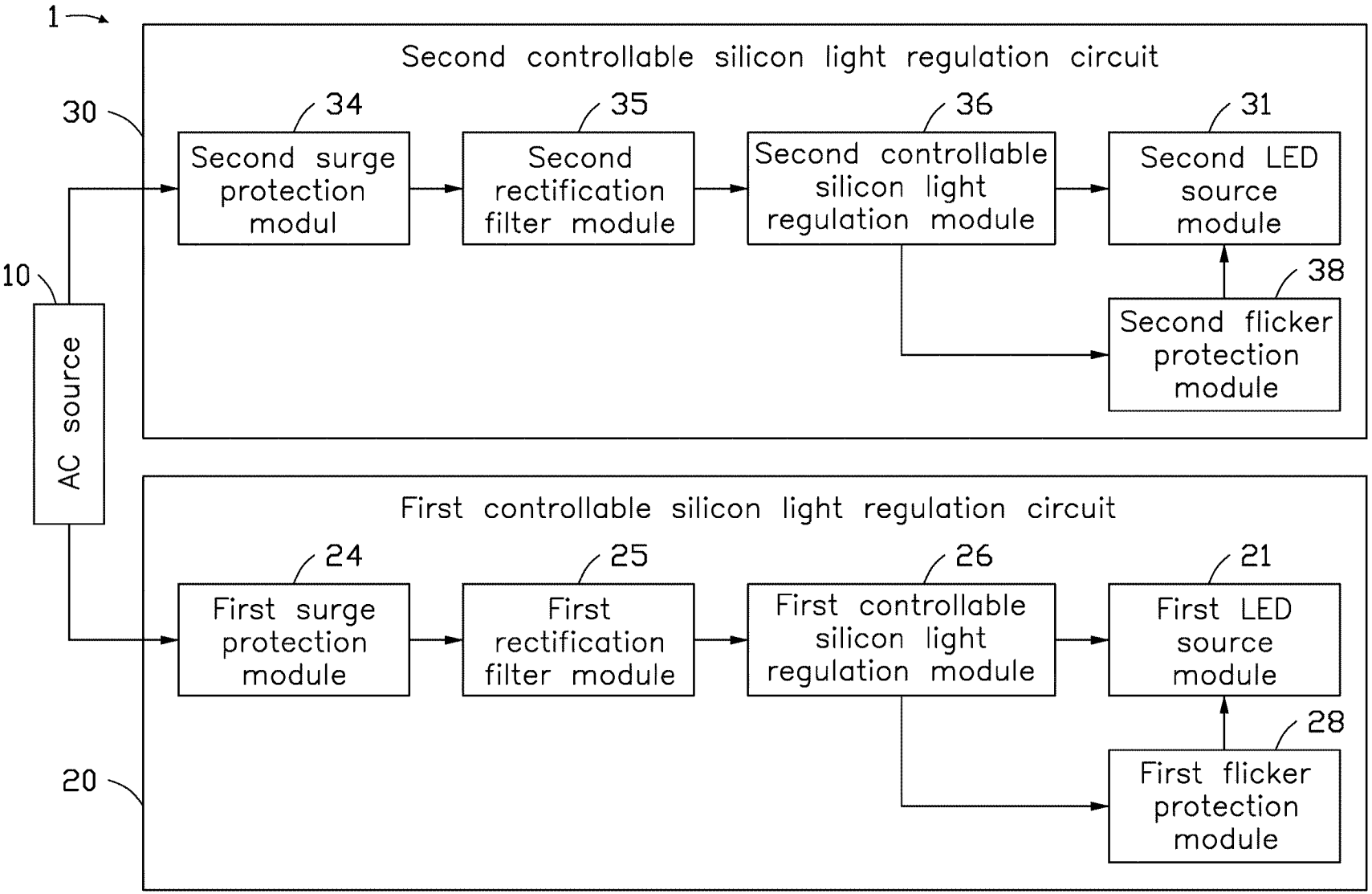
FIG. 1 is a diagram illustrating an embodiment of a controllable silicon light regulation apparatus, the controllable silicon light regulation apparatus includes a first light regulation circuit and a second light regulation circuit.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

In general, the word "module," as used herein, refers to logic embodied in hardware or firmware, or to a collection of software instructions, written in a programming language, for example, Java, C, or assembly. One or more software instructions in the modules may be embedded in firmware, such as an EPROM, magnetic, or optical drives. It will be appreciated that modules may comprise connected logic units, such as gates and flip-flops, and may comprise programmable units, such as programmable gate arrays or processors, such as a CPU. The modules described herein may be implemented as either software and/or hardware modules and may be stored in any type of computer-readable medium or other computer storage systems. The term "comprising" means "including, but not necessarily limited to"; it specifically indicates open-ended inclusion or membership in a so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

The present disclosure describes a controllable silicon light regulation apparatus.

FIG. 1 shows an embodiment of a controllable silicon light regulation apparatus 1. The controllable silicon light regulation apparatus 1 with light emitting diodes (LEDs) regulates color temperatures of light emitted by the LEDs based on an alternating current (AC) generated by an AC source 10. The controllable silicon light regulation apparatus 1 is capable of switching between a segment dimming mode and a linear dimming mode. In the segment dimming mode, the light of the LEDs of the controllable silicon light regulation apparatus 1 switches between different specified color temperatures. In a linear dimming mode, the light of the LEDs of the controllable silicon light regulation apparatus 1 is smoothly regulated between a first color temperature and a second color temperature based on a detected phase angle of the AC. The second color temperature is warmer than the first color temperature. In one embodiment, the first color temperature is 2200K, and the second color temperature is 6500K. In other embodiment, the second color temperature is 5000K.

The controllable silicon light regulation apparatus 1 includes a first controllable silicon light regulation circuit 20 and a second controllable silicon light regulation circuit 30. The first controllable silicon light regulation circuit 20 includes a first LED source module 21, and the second controllable silicon light regulation 30 includes a second LED source module 31. The first controllable silicon light regulation circuit 20 regulates a driving current for adjusting a color temperature of the light emitted by the first LED source module 21, and the second controllable silicon light regulation circuit 30 regulates a driving current for adjusting a color temperature of the light emitted by the second LED source module 31. The first LED source module 21 includes at least one LED, and the second LED source module 31 includes at least one LED. A maximum color temperature of the light emitted by the first LED source module 21 is the first color temperature, and a maximum color temperature of the light emitted by the second LED source module 31 is the second color temperature.

The first controllable silicon light regulation circuit 20 further includes a first surge protection module 24, a first rectification filter module 25, a first controllable silicon light regulation module 26, and a first flicker protection module 28.

Figure 2:
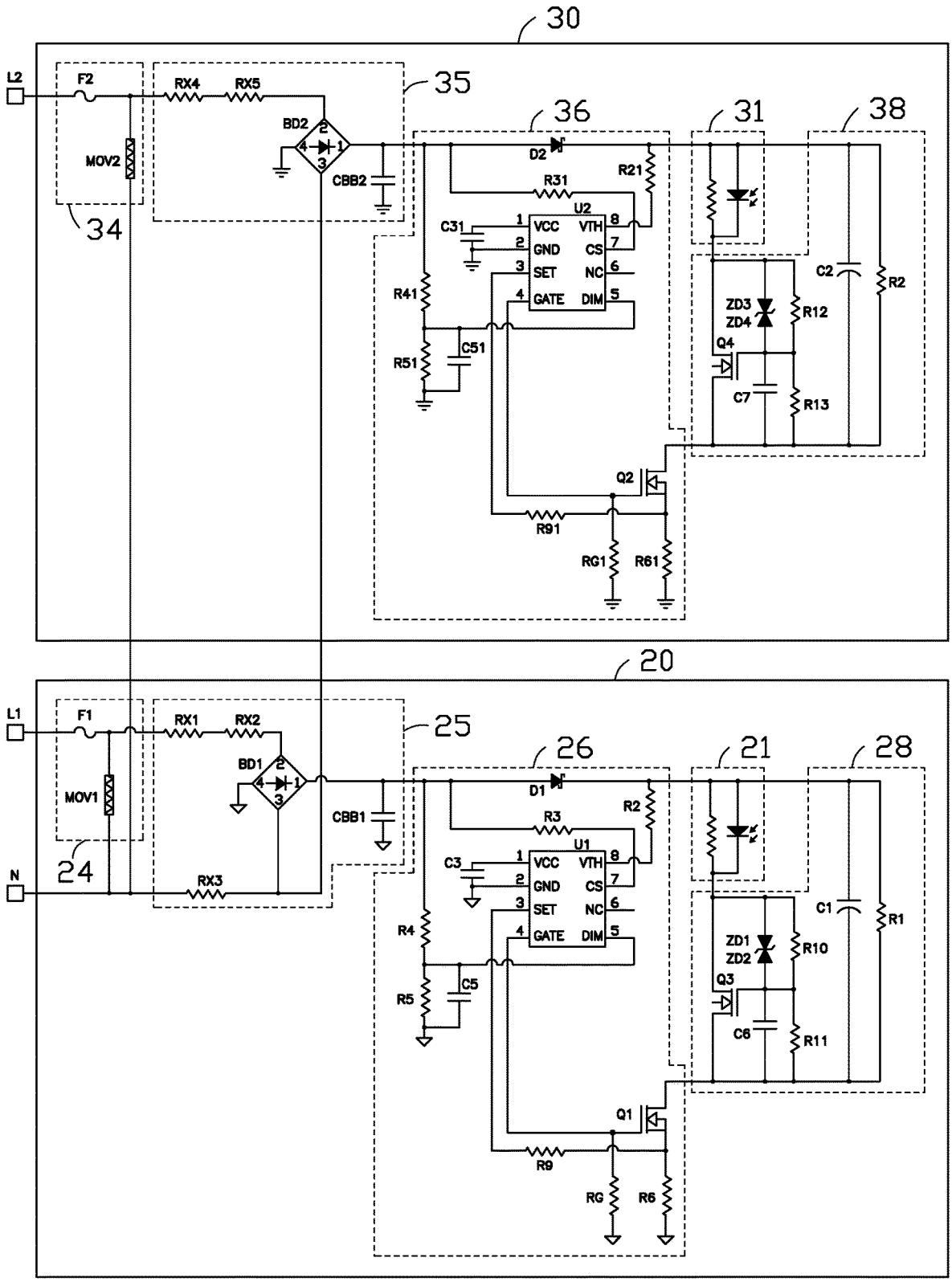
FIG. 2 is a circuit diagram illustrating an embodiment of the first light regulation circuit and the second light regulation circuit of FIG. 1.

FIG. 2 illustrates a circuit diagram of the first controllable silicon light regulation circuit 20 and the second controllable silicon light regulation circuit 30. The first surge protection module 24 transfers the AC from the AC source 10 to the first rectification filter module 25. The first surge protection module 24 cuts an electrical connection between the AC source 10 and the first rectification filter module 25, to protect the first controllable silicon light regulation circuit 20 against damage when an unexpected current or voltage surge. The first surge protection module 24 includes a fuse F1 and a varistor MOV1. A first terminal of the fuse F1 is electrically connected to a first terminal L1 of the AC source 10, and a second terminal of the fuse F1 is electrically connected to the first rectification filter module 25. A first terminal of the varistor MOV1 is electrically connected between the fuse F1 and the first rectification filter module 25. The varistor MOV1 protects the first controllable silicon light regulation circuit 20 from damage.

The first rectification filter module 25 is electrically connected between the fuse F1 and the first controllable silicon light regulation module 26. The first rectification filter module 25 filters the AC from the AC power 10, and converts the AC into direct current. The first rectification filter module 25 includes a first resistor RX1, a second resistor RX2, a third resistor RX3, a bridge diode BD1, and a filter capacitor CBB1. The first resistor RX1 and the second resistor RX2 are electrically connected between the fuse F1 and a first terminal of the bridge diode BD1 in series. A second terminal of the bridge diode BD1 is electrically connected to a first ground terminal, and a third terminal of the bridge diode BD1 is electrically connected to a second terminal N of the AC source 10 through the third resistor RX3. A fourth terminal of the bridge diode BD1 is electrically connected to the first controllable silicon light regulation module 26. A first terminal of the filter capacitor CBB1 is electrically connected to the four terminal of the bridge diode BD1, and a second terminal of the filter capacitor CBB1 is electrically connected to the first ground terminal.

The first controllable silicon light regulation module 26 is electrically connected between the first rectification filter module 25 and the first LED source module 21. The first controllable silicon light regulation module 26 generates the driving current to the first LED source module 21 based on the direct current generated by the first rectification filter module 25. The first controllable silicon light regulation module 26 includes a first chip U1, a first division resistor R4, a second division resistor R5, a second filter capacitor C5, a first transistor Q1, a first electromagnetic compatibility (EMI) protection resistor RG; and a third division resistor R6. The first division resistor R4 and the second division resistor R5 are electrically connected between the fourth terminal of the bridge diode BD1 and the first ground terminal in series. The first chip U1 is electrically connected to the first transistor Q1. The first chip U1 detects a phase angle of the AC and adjusts a duty ratio of a pulse width modulation (PWM) signal provided to a gate electrode of the first transistor Q1. The first chip U1 stores a plurality of specified color temperatures. In one embodiment, the number of the specified color temperatures is 42. A difference between adjacent specified color temperatures is 100K. The first chip U1 selects a specified number of the specified color temperatures as target color temperatures based on a segment value. In one embodiment, the target color temperatures are separated from each other. In other embodiments, the target color temperatures can be adjacent. In one embodiment, the first chip U1 stores a table of the segment value and the target color temperatures. A source electrode of the first transistor Q1 is electrically connected to the first ground terminal through the third division resistor R6, and a drain electrode of the first transistor Q1 is electrically connected to the first flicker protection module 28.

The first flicker protection module 28 is electrically connected between the first controllable silicon light regulation module 25 and the first LED source module 21. The first flicker protection module 28 prevents the first LED source module 21 from flickering. The first flicker protection module 28 includes a second transistor Q3, a first diode ZD1, a second diode ZD2, a first protection resistor R10, a second protection resistor R11, a first protection capacitor C1, a second protection capacitor C6, and a third protection resistor R1. A gate electrode of the second transistor Q3 is electrically connected to the first LED source module 21 through the first diode ZD1 and the second diode ZD2, a drain electrode of the second transistor Q3 is electrically connected to the drain electrode of the first transistor Q1, and a source electrode of the second transistor Q3 is electrically connected to the first LED source module 21. An anode of the first diode ZD1 is electrically connected to the source electrode of the second transistor Q3, and a cathode of the first diode ZD1 is electrically connected to an anode of the second diode ZD2. A cathode of the second diode ZD2 is electrically connected to the gate electrode of the second transistor Q3. The third protection resistor R1 and the first protection capacitor C1 are electrically connected in parallel between the first LED source module 21 and the drain electrode of the second transistor Q3. The first protection resistor R10 and the second protection resistor R11 are electrically connected between the source electrode and the drain electrode of the second transistor Q3 in series. A first terminal of the second protection capacitor C6 is electrically connected to the cathode of the second diode ZD2, and a second terminal of the second protection capacitor C6 is electrically connected to the drain electrode of the second transistor Q3.

The second controllable silicon light regulation circuit 30 includes a second surge protection module 34, a second rectification filter module 35, a second controllable silicon light regulation module 36, and a second flicker protection module 38. The second surge protection module 34 is electrically connected between a third terminal L2 of the AC power 10 and the second rectification filter module 35. The structure of the second surge protection module 34 is similar to the structure of the first surge protection module 24. The structure of the second rectification filter module 35 is similar to the structure of the first second rectification filter module 25. The structure of the second controllable silicon light regulation module 36 is similar to the structure of the first controllable silicon light regulation module 26. The structure of the second flicker protection module 38 is similar to the structure of the first flicker protection module 28.

In the segment dimming mode, a switch (not shown) is provided for controlling the AC source 10, and the AC source outputs the AC when the switch is turned on. The controllable silicon light regulation apparatus 1 counts a number of times the switch is turned on (or a number of turn-on times) in a specified time duration, and regulates the driving current to the first LED source module 21 and the second LED source module 31 based on the counted number of turn-on times, thus the color temperature of the light emitted by the controllable silicon light regulation apparatus 1 is gradually regulated in a loop between the target color temperatures. In one embodiment, the higher the number of turn-on times is, the warmer is the color temperature. In other embodiments, the higher the number of turn-on times, the cooler is the color temperature. The light emitted by the controllable silicon light regulation apparatus 1 is mixed by the first LED source module 21 and the second LED source module 31. When the segment value is N, there are N target color temperatures. In one embodiment, the specified time duration is 1 second.

When the segment value is 3, the light emitted by the controllable silicon light regulation apparatus 1 is capable of switching between three target color temperatures based on the counted number of turn-on times in the specified time duration. When the number of turn-on times is counted to be 1, the light emitted by the controllable silicon light regulation apparatus 1 is in a first target color temperature. In one embodiment, the first target color temperature is 2700K. Under the first target color temperature, the first LED source module 21 and the second LED source module 31 emit light. The color temperature of the light emitted by the first LED source module 21 is 87% of the first color temperature, and the color temperature of the light emitted by the second LED source module 31 is 13% of the second color temperature. When the number of counted turn-on times is counted to be 2, the light emitted by the controllable silicon light regulation apparatus 1 is in a second target color temperature, which is warmer than the first target color temperature. In one embodiment, the second target color temperature is 3000K. Under the second target color temperature, the first LED source module 21 and the second LED source module 31 emit light. The color temperature of the light emitted by the first LED source module 21 is 83% of the first color temperature, and the color temperature of the light emitted by the second LED source module 31 is 17% of the second color temperature. When the counted number of turn-on times is counted to be 3, the light emitted by the controllable silicon light regulation apparatus 1 is in a third target color temperature, which is warmer than the second specified color temperature. In one embodiment, the third target color temperature is 5000K. Under the third target color temperature, the first LED source module 21 and the second LED source module 31 emit light. The color temperature of the light emitted by the first LED source module 21 is 33% of the first color temperature, and the color temperature of the light emitted by the second LED source module 31 is 67% of the second color temperature.

When the segment value is 5, the light emitted by the controllable silicon light regulation apparatus 1 is capable of switching between five target color temperatures based on the counted number of turn-on times in the specified time duration. When the counted number is 1, the light emitted by the controllable silicon light regulation apparatus 1 is in a first target color temperature. In one embodiment, the first target color temperature is the first color temperature. Under the first target color temperature, the color temperature of the light emitted by the first LED source module 21 is the first color temperature, and the second LED source module 31 stops emitting light. When the counted number is 2, the light emitted by the controllable silicon light regulation apparatus 1 is in a second target color temperature, which is warmer than the first target color temperature. In one embodiment, the second target color temperature is 2700K. Under the second target color temperature, the first LED source module 21 and the second LED source module 31 emit light. The color temperature of the light emitted by the first LED source module 21 is 87% of the first color temperature, and the color temperature of the light emitted by the second LED source module 31 is 13% of the second color temperature. When the counted number is 3, the light emitted by the controllable silicon light regulation apparatus 1 is in a third target color temperature, which is warmer than the second target color temperature. In one embodiment, the third target color temperature is 3000K. Under the third target color temperature, the first LED source module 21 and the second LED source module 31 emit light. The color temperature of the light emitted by the first LED source module 21 is 83% of the first color temperature, and the color temperature of the light emitted by the second LED source module 31 is 17% of the second color temperature. When the counted number is 4, the light emitted by the controllable silicon light regulation apparatus 1 is in a fourth specified color temperature, which is warmer than the third target color temperature. In one embodiment, the fourth target color temperature is 5000K. Under the fourth target color temperature, the first LED source module 21 and the second LED source module 31 emit light. The color temperature of the light emitted by the first LED source module 21 is 33% of the first color temperature, and the color temperature of the light emitted by the second LED source module 31 is 67% of the second color temperature. When the counted number is 5, the light emitted by the controllable silicon light regulation apparatus 1 is in a fifth target color temperature, which is warmer than the fourth target color temperature. In one embodiment, the fifth target color temperature is 6500K. Under the fifth target color temperature, the first LED source module 21 stops emitting light, and the second LED source module 31 emits light. The color temperature of the light emitted by the second LED source module 31 is the second color temperature.

When the segment value is 6, the light emitted by the controllable silicon light regulation apparatus 1 is capable of switching between six target color temperatures based on the counted number of turn-on times in the specified time duration. When the counted number is 1, the light emitted by the controllable silicon light regulation apparatus 1 is in a first target color temperature. In one embodiment, the first target color temperature is the first color temperature. Under the first target color temperature, the color temperature of the light emitted by the first LED source module 21 is the first color temperature, and the second LED source module 31 stops emitting light. When the counted number is 2, the light emitted by the controllable silicon light regulation apparatus 1 is in a second target color temperature, which is warmer than the first target color temperature. In one embodiment, the second target color temperature is 2700K. Under the second target color temperature, the first LED source module 21 and the second LED source module 31 emit light. The color temperature of the light emitted by the first LED source module 21 is 87% of the first color temperature, and the color temperature of the light emitted by the second LED source module 31 is 13% of the second color temperature. When the counted number is 3, the light emitted by the controllable silicon light regulation apparatus 1 is in a third specified color temperature, which is warmer than the second target color temperature. In one embodiment, the third target color temperature is 3000K. Under the third target color temperature, the first LED source module 21 and the second LED source module 31 emit light. The color temperature of the light emitted by the first LED source module 21 is 83% of the first color temperature, and the color temperature of the light emitted by the second LED source module 31 is 17% of the second color temperature. When the counted number is 4, the light emitted by the controllable silicon light regulation apparatus 1 is in a fourth target color temperature, which is warmer than the third target color temperature. In one embodiment, the fourth target color temperature is 4000K. Under the fourth target color temperature, the first LED source module 21 and the second LED source module 31 emit light. The color temperature of the light emitted by the first LED source module 21 is 60% of the first color temperature, and the color temperature of the light emitted by the second LED source module 31 is 40% of the second color temperature. When the counted number is 5, the light emitted by the controllable silicon light regulation apparatus 1 is in a fifth target color temperature, which is warmer than the fourth target color temperature. In one embodiment, the fifth target color temperature is 5000K. Under the fifth target color temperature, the first LED source module 21 and the second LED source module 31 emit light. The color temperature of the light emitted by the first LED source module 21 is 33% of the first color temperature, and the color temperature of the light emitted by the second LED source module 31 is 67% of the second color temperature. When the counted number is 6, the light emitted by the controllable silicon light regulation apparatus 1 is in a sixth target color temperature, which is warmer than the fifth target color temperature. In one embodiment, the sixth target color temperature is the second color temperature. Under the fifth target color temperature, the first LED source module 21 stops emitting light, and the second LED source module 31 emits light. The color temperature of the light emitted by the second LED source module 31 is the second color temperature.

In linear dimming mode, the first controllable silicon light regulation circuit 20 detects the phase angle of the first terminal L1, and regulates the duty ratio of the PWM provided to the first LED source module 21, thus the color temperature of the light emitted by the first LED source module 21 is linearly changed. The second controllable silicon light regulation circuit 30 detects the phase angle of the third terminal L2, and regulates the duty ratio of the PWM provided to the second LED source module 31, thus the color temperature of the light emitted by the second LED source module 31 is linearly changed.

Based on the structure of the controllable silicon light regulation apparatus 1, the controllable silicon light regulation apparatus 1 switches between the segment dimming mode and the linear segment dimming mode. The controllable silicon light regulation apparatus 1 is driven by the AC source without a driving power element. Thus, the cost of the controllable silicon light regulation apparatus 1 is reduced.

While various and preferred embodiments have been described the disclosure is not limited thereto. On the contrary, various modifications and similar arrangements (as would be apparent to those skilled in the art) are also intended to be covered. Therefore, the scope of the appended claims should be accorded the broadest interpretation so as to encompass all such modifications and similar arrangements.

What is claimed is:

1. A controllable silicon light regulation apparatus receiving an alternating current (AC) from an AC source; the controllable silicon light regulation apparatus comprising:

a first light emitting diode (LED) source module configured to emit light based on the AC;

a second LED source module configured to emit light based on the AC;

a first controllable silicon light regulation circuit with a first chip configured to provide a first driving current to the first LED source module to emit light, and to adjust the first driving current for adjusting a color temperature of the first LED source; and a second controllable silicon light regulation circuit with a second chip configured to provide a second driving current to the second LED source module to emit light, and to adjust the second driving current for adjusting a color temperature of the second LED source;

wherein a color temperature of light emitted by the controllable silicon light regulation apparatus is in a range from a first color temperature to a second color temperature; the light emitted by the first LED source module and the light emitted by the second LED source module are mixed by the controllable silicon light regulation apparatus; the first chip stores a plurality of first specified color temperatures, and the second chip stores a plurality of second specified color temperatures; a difference between two adjacent specified color temperatures is 100 Kelvin (K); under a segment dimming mode, the first chip and the second chip respectively set a segment value, and the first chip selects a number of the plurality of the first specified color temperatures as first target color temperatures based on the set segment value, the second chip selects a number of the plurality of the second specified color temperatures as second target temperature based on the set segment value; the segment value is related to a counted number of turn-on times of the AC source in a specified time duration, and each turn-on time corresponds to a first target color temperature and a second target color temperature; a color temperature of the controllable silicon light regulation apparatus is gradually regulated in a loop of target color temperatures; each target color temperature is a mixture of one of the first target color temperatures and one of the second target color temperatures.

2. The controllable silicon light regulation apparatus of claim 1, wherein the first controllable silicon light regulation circuit further comprises a first surge protection module; the first surge protection module protects the first controllable silicon light regulation circuit from being damaged when an unexpected current of the AC source is generated.

3. The controllable silicon light regulation apparatus of claim 2, wherein the first surge protection module comprises a fuse and a varistor; a first terminal of the fuse is electrically connected to a first terminal of the AC source, and a second terminal of the fuse is electrically connected to the first LED source module; a first terminal of the varistor is electrically connected between the fuse and the first LED source module, and a second terminal of the varistor is electrically connected to a first ground terminal.

4. The controllable silicon light regulation apparatus of claim 1, wherein the second controllable silicon light regulation circuit further comprises a second surge protection module; the second surge protection module protects the second controllable silicon light regulation circuit from being damaged when an unexpected current of the AC source is generated.

5. The controllable silicon light regulation apparatus of claim 1, wherein the controllable silicon light regulation apparatus is operated under a linear dimming mode; under the linear dimming mode, the color temperature of the light emitted by the controllable silicon light regulation apparatus is linearly regulated based on a detected phase angle of the AC.

6. The controllable silicon light regulation apparatus of claim 5, wherein the controllable silicon light regulation apparatus further comprises a first controllable silicon light regulation module and a second controllable silicon light regulation; the first controllable silicon light regulation module is electrically connected to the first LED source module and detects a phase angle of a first terminal of the AC for linearly dimming the color temperature of the light emitted by the first LED source module; the second controllable silicon light regulation module is electrically connected to the second LED source module, and detects a phase angle of a second terminal of the AC for linearly dimming the color temperature of the light emitted by the second LED source module.

7. The controllable silicon light regulation apparatus of claim 1, wherein when the segment value is 3, the controllable silicon light regulation apparatus selects three of the target color temperatures; the controllable silicon light regulation apparatus counts the number of turn-on times of the AC source in the specified time duration, and gradually regulates the color temperature of the light in a loop between the three selected target color temperatures.

8. The controllable silicon light regulation apparatus of claim 7, wherein the first target color temperature is 2700K, the second target color temperature is 3000K, and the third target color temperature is 5000K.

9. The controllable silicon light regulation apparatus of claim 1, wherein when the segment value is 5, the controllable silicon light regulation apparatus selects five of the target color temperatures; the controllable silicon light regulation apparatus counts the number of turn-on times of the AC source in the specified time duration, and gradually regulates the color temperature of the light in a loop between the five selected target color temperatures.

10. The controllable silicon light regulation apparatus of claim 9, wherein the first target color temperature is 2200K, the second target color temperature is 2700K, the third target color temperature is 3000K, the fourth target color temperature is 5000K, and the fifth target color temperature is 6500K.

11. The controllable silicon light regulation apparatus of claim 1, wherein when the segment value is 6, the controllable silicon light regulation apparatus selects six of the target color temperatures; the controllable silicon light regulation apparatus counts the number of turn-on times of the AC source in the specified time duration, and gradually regulates the color temperature of the light in a loop between the six selected target color temperatures.

12. The controllable silicon light regulation apparatus of claim 11, wherein the first target color temperature is 2200K, the second target color temperature is 2700K, the third target color temperature is 3000K, the fourth target color temperature is 4000K, a fifth target color temperature is 5000K, and the sixth target color temperature is 6500K.

13. The controllable silicon light regulation apparatus of claim 1, wherein the first color temperature is 2200K, and the second color temperature is 6500K.

14. The controllable silicon light regulation apparatus of claim 1, wherein the specified time duration is 1 second.

15. The controllable silicon light regulation apparatus of claim 1, wherein the first controllable silicon light regulation circuit further comprises a first rectification filter module; the first rectification filter module filters the AC from a first terminal of the AC power and converts the AC into a direct current.

16. The controllable silicon light regulation apparatus of claim 1, wherein the second controllable silicon light regulation circuit further comprises a second rectification filter module; the second rectification filter module filters the AC from a second terminal of the AC power, and converts the AC into a direct current.

17. The controllable silicon light regulation apparatus of claim 1, wherein the first controllable silicon light regulation circuit further comprises a first flicker protection module; the first flicker protection module prevents the first LED source module from being flicker.

18. The controllable silicon light regulation apparatus of claim 1, wherein the second controllable silicon light regulation circuit further comprises a second flicker protection module; the second flicker protection module prevents the second LED source module from being flicker.

* * * * *